US010173850B2

(12) United States Patent
Nitta et al.

(10) Patent No.: US 10,173,850 B2
(45) Date of Patent: Jan. 8, 2019

(54) SHEET FEEDING DEVICE AND IMAGE FORMING APPARATUS

(71) Applicant: CANON KABUSHIKI KAISHA, Tokyo (JP)

(72) Inventors: Jumpei Nitta, Machida (JP); Fuyuto Yamashita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/662,136

(22) Filed: Jul. 27, 2017

(65) Prior Publication Data

US 2018/0044125 A1 Feb. 15, 2018

(30) Foreign Application Priority Data

Aug. 9, 2016 (JP) ..... 2016-156769

(51) Int. Cl.
*B65H 1/04* (2006.01)

(52) U.S. Cl.
CPC ..... *B65H 1/04* (2013.01); *B65H 2402/31* (2013.01); *B65H 2402/32* (2013.01); *B65H 2402/45* (2013.01); *B65H 2405/115* (2013.01); *B65H 2405/1122* (2013.01); *B65H 2405/1124* (2013.01); *B65H 2405/111643* (2013.01); *B65H 2405/324* (2013.01); *B65H 2511/11* (2013.01); *B65H 2511/20* (2013.01); *B65H 2801/12* (2013.01)

(58) Field of Classification Search
CPC ..... B65H 2402/45; B65H 2405/1124; B65H 2405/115; B65H 2405/1122; B65H 2405/1142; B65H 2405/11425; B65H 2405/1144
USPC ..... 271/171
See application file for complete search history.

(56) References Cited

U.S. PATENT DOCUMENTS 7,097,172 B2 * 8/2006 Chang ..... B65H 1/04 271/145
8,292,290 B2 * 10/2012 Ishii ..... B65H 1/266 271/171

FOREIGN PATENT DOCUMENTS

JP 2011219189 A 11/2011
JP 2015143148 A 8/2015

* cited by examiner

*Primary Examiner* — Jeremy R Severson
(74) *Attorney, Agent, or Firm* — Canon U.S.A, Inc. IP Division

(57) ABSTRACT

A sheet feeding device for feeding a sheet includes a support unit, an open-close member rotatably supported between open and closed positions, a slide member supported in a slidably movable manner and including a rotation shaft portion, and a regulation member supported by the slide member. The open-close member supports the sheet in the open position with the support unit. The regulation member regulates a position of the sheet supported by the support unit or the sheet supported by the support unit and the open-close member. The support unit includes a guide portion that movably guides the rotation shaft portion. If the open-close member is rotated from the open position toward the closed position in a state in which the open-close member is in contact with the slide member, the slide member rotates by following movement of the open-close member with respect to the guide member.

10 Claims, 16 Drawing Sheets

SHEET FEEDING DEVICE AND IMAGE FORMING APPARATUS

BACKGROUND OF THE INVENTION

Field of the Invention

The disclosed information relates to a sheet feeding device that feeds a sheet, and an image forming apparatus including the sheet feeding device.

Description of the Related Art

Conventionally, examples of image forming apparatuses include an electrophotographic copying machine, an electrophotographic printer such as a light emitting diode (LED) printer and a laser beam printer, an electrophotographic facsimile machine, and an electrophotographic word processor. Such an image forming apparatus includes a sheet feeding device, and the image forming apparatus for forming an image on a sheet fed from the sheet feeding device to an image forming unit has become widespread.

Generally, the image forming apparatus includes a sheet supplying cassette serving as a sheet storage unit. The sheet supplying cassette is attached to an image forming apparatus main body in a pullable manner, and a sheet stored in the sheet supplying cassette is automatically fed to the image forming unit by a sheet feeding roller.

The sheet supplying cassette in which sheets are stored includes a rear-end regulating member that regulates a position of a sheet feeding direction rear end (hereinafter referred to as a rear end) of a sheet to be stored when a sheet smaller than a maximum storable size sheet is stored. Moreover, the sheet supplying cassette includes side-end regulating members that regulate positions of side ends of a sheet in a direction (hereinafter referred to as a width direction) perpendicular to a sheet feeding direction.

In such a sheet supplying cassette, the side-end regulating member and the rear-end regulating member respectively regulate the side ends and the rear end of the sheet such that a leading-end position of the sheet is constantly regulated in a predetermined position. Accordingly, when the sheet supplying cassette is stored in the image forming apparatus main body, a sheet can be stably fed regardless of sheet size.

Meanwhile, there is a related-art image forming apparatus including a sheet storage space arranged in an image forming apparatus main body to reduce size thereof instead of using a sheet supplying cassette, and sheets are stored in the sheet storage space. Such an image forming apparatus can include a cover (an open-close member) that is opened and closed with respect to the sheet storage space according to sheet size. In such a case, the cover is opened such that a sheet is placed across the opened cover and a sheet stacking surface of the sheet storage space.

Japanese Patent Application Laid-Open No. 2011-219189 discusses a slide member. When a cover supports a sheet, the slide member supports a rear-end regulating member such that the rear-end regulating member can be moved to a position on the cover.

In Japanese Patent Application Laid-Open No. 2011-219189, the slide member, which supports the rear-end regulating member, includes two components that are an arm for supporting the rear-end regulating member and a movement member for rotatably supporting the arm. Moreover, the slide member moves the movement member in a sliding manner with respect to a feeding tray serving as a support unit. In addition, according to the configuration discussed in Japanese Patent Application Laid-Open No. 2011-219189, the arm needs to be rotated with respect to the movement member when the slide member is rotated.

Consequently, the arm cannot be directly moved in a sliding manner with respect to the support unit in the configuration discussed in Japanese Patent Application Laid-Open No. 2011-219189. This increases the number of components. Moreover, a large space is necessary on a sheet supplying tray for rotation of the slide member including the movement member and the arm.

SUMMARY OF THE INVENTION

The disclosed information is directed to a sheet feeding device capable of regulating a rear end of a sheet with a simple and space-saving configuration, and to an image forming apparatus.

According to an aspect of the present invention, a sheet feeding device for feeding a sheet includes a support unit configured to support the sheet, a feeding unit configured to feed the sheet supported by the support unit, an open-close member, arranged on an upstream side of the support unit in a feeding direction of the sheet and rotatably supported between an open position and a closed position with respect to the support unit, configured to support the sheet in the open position with the support unit, a slide member supported in a slidably movable manner in the feeding direction with respect to the support unit, the slide member including a rotation shaft portion on a downstream side in the feeding direction, and a regulation member, supported by the slide member, configured to regulate a position on an upstream end in the feeding direction of the sheet supported by the support unit or the sheet supported by the support unit and the open-close member, wherein the support unit includes a guide portion configured to movably guide the rotation shaft portion, and wherein, if the open-close member is rotated from the open position toward the closed position in a state in which the open-close member is in contact with the slide member, the slide member rotates by following movement of the open-close member with respect to the guide member around the rotation shaft portion.

Further features of the present invention will become apparent from the following description of exemplary embodiments with reference to the attached drawings.

DESCRIPTION OF THE EMBODIMENTS

[Overall Configuration]

Figure 1:
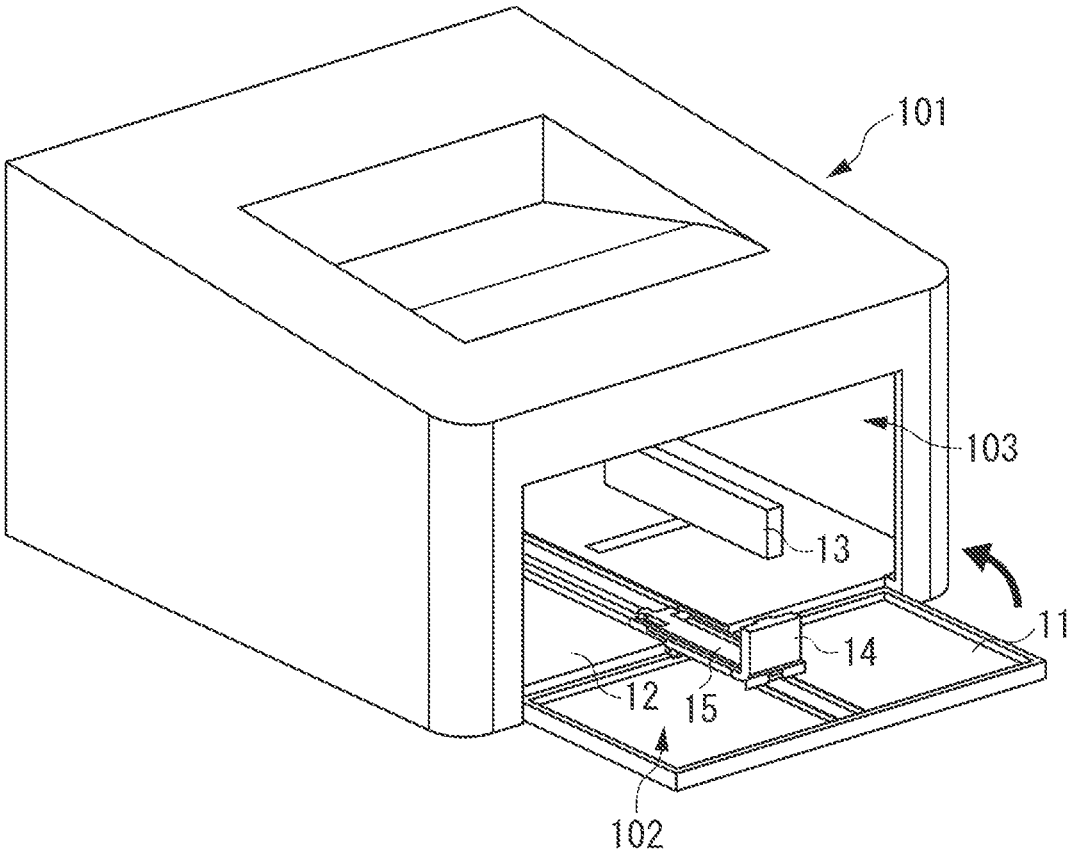
FIG. 1 a perspective view illustrating an image forming apparatus according to a first exemplary embodiment.
Figure 2:
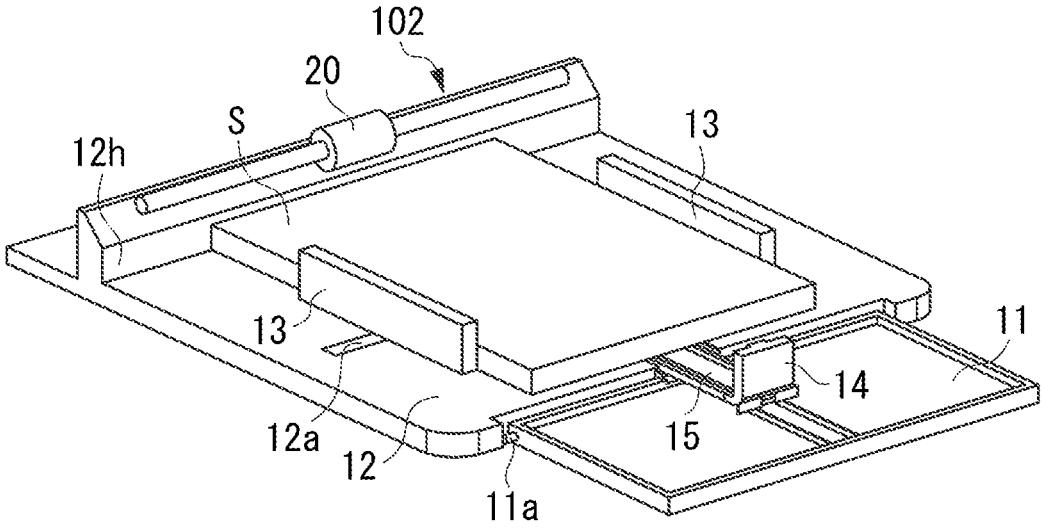
FIG. 2 is a perspective view illustrating a configuration of a sheet feeding device according to the first exemplary embodiment.
Figure 16:
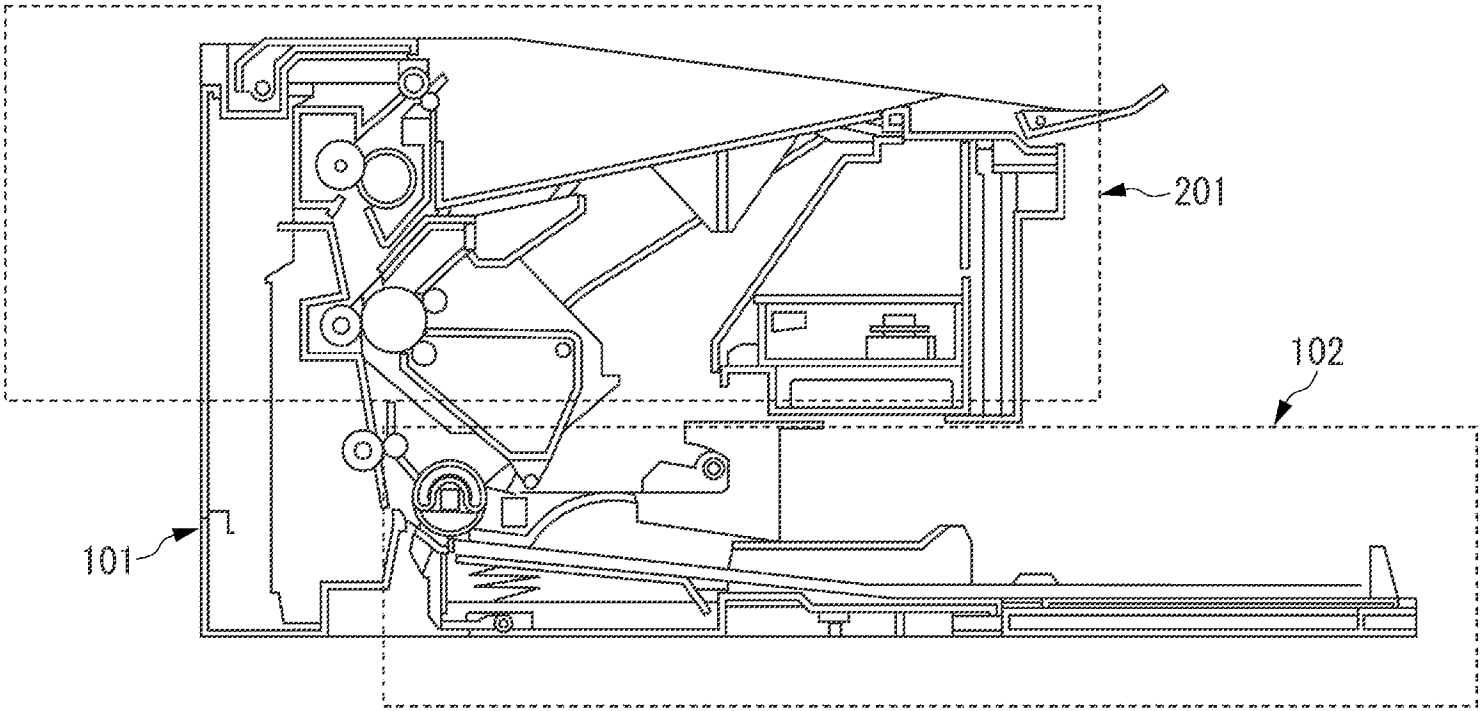
FIG. 16 is a schematic sectional view illustrating the image forming apparatus according to the first exemplary embodiment.

A first exemplary embodiment is described. A printer 101 (an image forming apparatus) according to the first exemplary embodiment is an electrophotographic laser beam printer. The printer 101, as illustrated in FIGS. 1, 2, and 16, includes a sheet feeding device 102 and an image forming unit 201. The sheet feeding device 102 feeds a sheet. The image forming unit 201 forms an image on the sheet fed from the sheet feeding device 102 as illustrated in FIG. 16.

The image forming unit 201 illustrated in FIG. 16 is a conventionally known image forming unit that forms an image on a sheet by an electrophotographic method. In particular, the image forming unit 201 forms an electrostatic latent image on a photoconductor drum inside a process cartridge by using a laser beam emitted from a laser scanner unit, and visualizes the electrostatic latent image as a toner image by using a developing unit. Subsequently, the image forming unit 201 transfers the toner image to a sheet fed from the sheet feeding device 102. Then, the image forming unit 201 causes a fixing device to fix the toner image on the sheet, thereby forming the image on the sheet.

The sheet feeding device 102 includes a feeding tray 12 arranged in the printer 101, a feeding roller 20 (a feeding unit) that feeds a sheet S stacked on the feeding tray 12, and an open-close cover 11 serving as an open-close member. The open-close cover 11 is supported such that the open-close cover 11 can be opened and closed with respect to the printer 101. The feeding tray 12 (a support unit) supports a downstream side of the sheet S in a sheet feeding direction, and the open-close cover 11 can support an upstream side of the sheet S. On the open-close cover 11, a slide member 15 that is described below is supported in a slidably movable manner. The open-close cover 11 and the slide member 15 form an upstream side sheet stacking portion that is arranged on an upstream side of the feeding tray 12 in the sheet feeding direction.

FIG. 2 is a perspective view illustrating the sheet feeding device 102. The feeding tray 12 includes a guide portion 12*a* extending in a sheet width direction perpendicular to the sheet feeding direction. In the guide portion 12*a*, a pair of side regulating plates 13 and 13 is movably supported in the sheet width direction. The side regulating plates 13 and 13 regulate positions of end portions of the sheet S, which is stacked on the feeding tray 12, in the sheet width direction. Moreover, the feeding tray 12 includes a leading-end regulating surface 12*h* that regulates a position of a downstream-end (a leading-end) of the sheet S in the sheet feeding direction.

Figure 9:
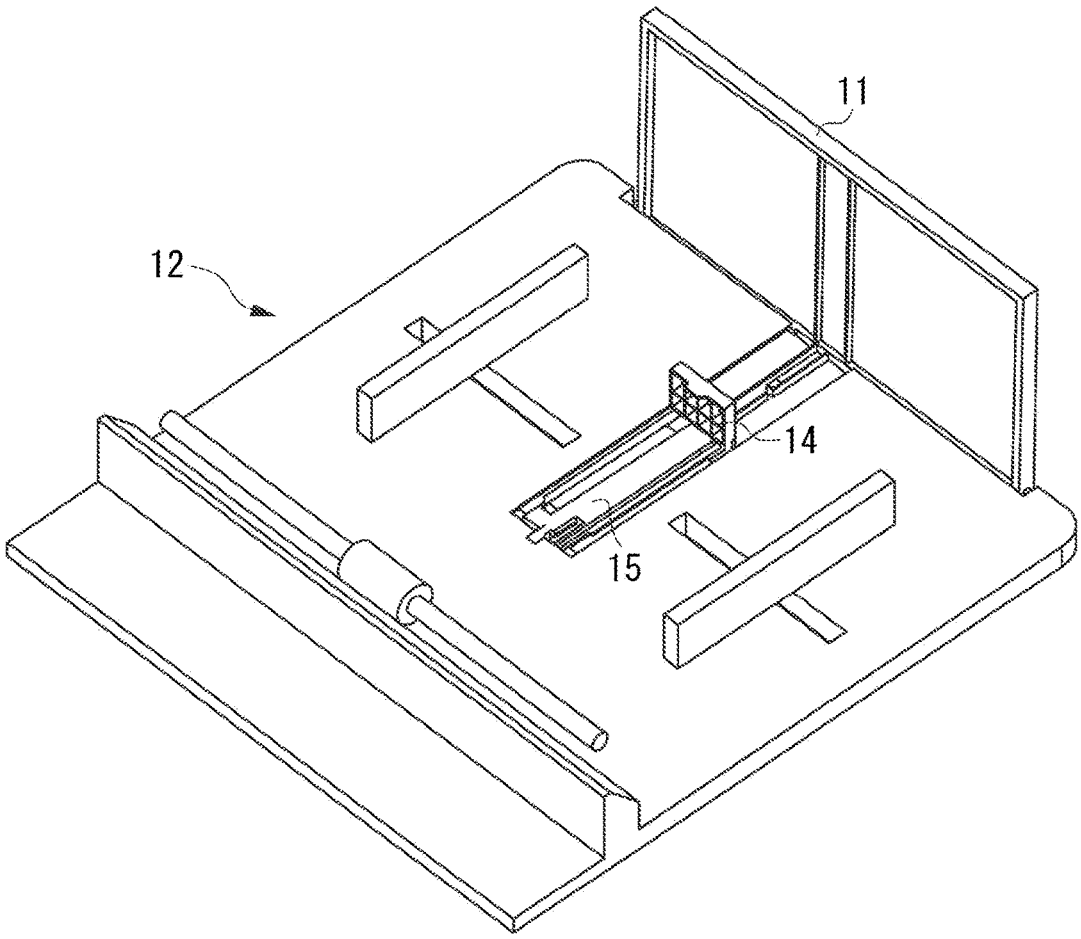
FIG. 9 is a perspective view illustrating a closed position of the open-close member according to the first exemplary embodiment.

The open-close cover 11 is rotatable between an open position a (see FIG. 1) and a closed position (see FIG. 9) around a rotation shaft 11*a* as a fulcrum. When the open-close cover 11 is in the closed position, the open-close cover 11 functions as a front cover of the printer 101. On the open-close cover 11, a rear-end regulating member 14 is movably supported in the sheet feeding direction via the slide member 15.

When an image is formed on a sheet S, a user rotates the feeding tray 12 from the closed position to the open position to open a sheet storage space 103 inside the printer 101. The sheet storage space 103 is provided to store sheets S. The user inserts the sheets S in the sheet storage space 103 to stack the sheets S on the feeding tray 12 and the open-close cover 11, and positions of the sheets S are respectively regulated by the side regulating plates 13 and 13, the leading-end regulating surface 12*h*, and the rear-end regulating member 14. The rear-end regulating member 14 regulates a position of an upstream end of the sheets S. Therefore, when the sheet S is fed by the feeding roller 20, the sheet S is prevented from being displaced, skewed, or jammed. That is, the sheet can be stably fed.

[Configuration for Operation of Rear-End Regulating Member]

Figure 3A:
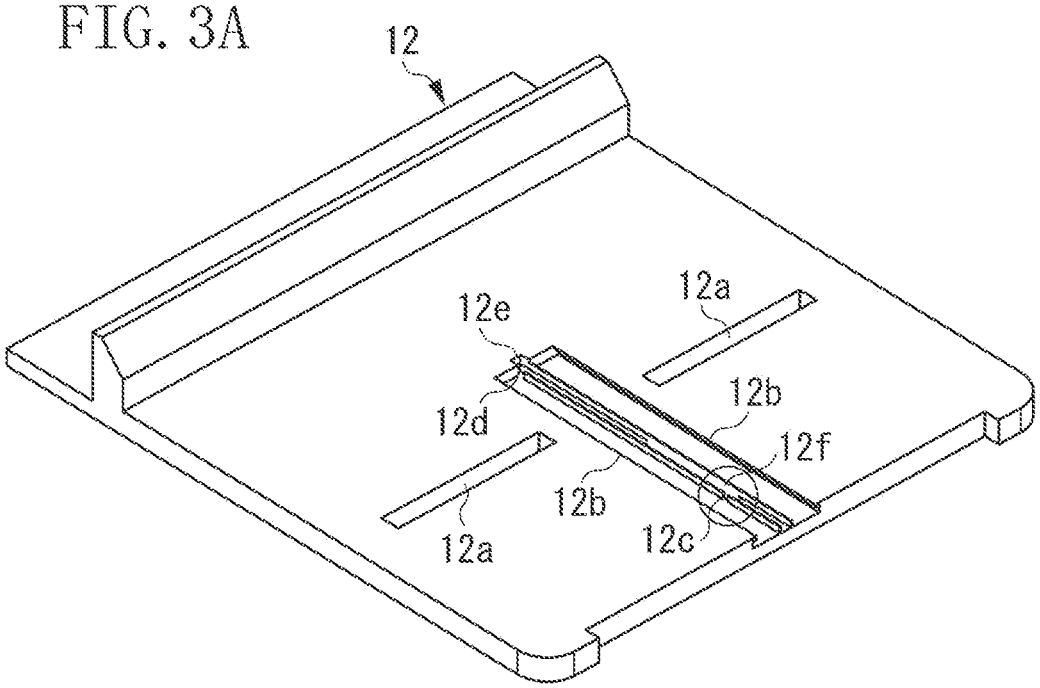
FIG. 3A is a perspective view illustrating a support unit according to the first exemplary embodiment.
Figure 3B:
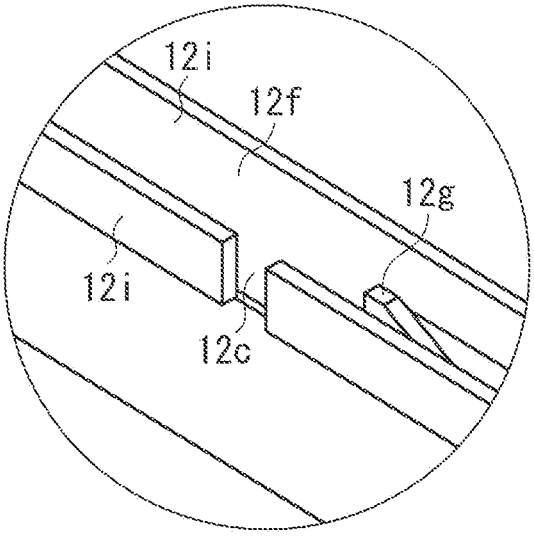
FIG. 3B is an enlarged view illustrating one portion of the support unit illustrated in FIG. 3A.

A configuration for operation of the rear-end regulating member 14 (a regulation member) is described in detail. FIG. 3A is a perspective view illustrating the feeding tray 12. FIG. 3B is an enlarged view illustrating one portion of the feeding tray 12 illustrated FIG. 3A. The feeding tray 12 includes a pair of slide guide portions 12*b* and 12*b* (guide portions) extending in the sheet feeding direction. The slide member 15 includes a pair of rotation shaft portions 15*a* and 15*a* as guided units. The rotation shaft portion 15*a* is guided by the slide guide portion 12*b* with respect to the feeding tray 12, so that the slide member 15 can slide in the feeding direction. Moreover, the rotation shaft portion 15*a* contacts the slide guide portion 12*b* to regulate a height-direction position of the slide member 15. The feeding tray 12 includes a contact surface 12*e*, and the slide member 15 includes a downstream end 15*c* in the sheet feeding direction. The downstream end 15*c* of the slide member 15 contacts the contact surface 12*e* of the feeding tray 12. Moreover, in the present exemplary embodiment, the rotation shaft portion 15*a* has a projection shape projecting from the slide member 15 toward the slide guide portion 12*b* in a width direction perpendicular to the feeding direction. However, the rotation shaft portion 15*a* may be configured as a recess, and the slide guide portion 12*b* may be configured as a projection.

In the vicinity of the contact surface 12*e*, a first engaged portion 12*d* that is to be engaged with a hook 15*b* serving as an engagement portion of the slide member 15 is arranged.

Moreover, surface portions 12*i* and 12*i* form a groove portion 12*f* between the slide guide portions 12*b* and 12*b*. A second engaged portion 12*c* that can be engaged with the hook 15*b* is arranged in one portion of the surface portion 12*i*. A stopper rib 12*g* is arranged in the vicinity of a cut portion 12*c*.

Figure 4A:
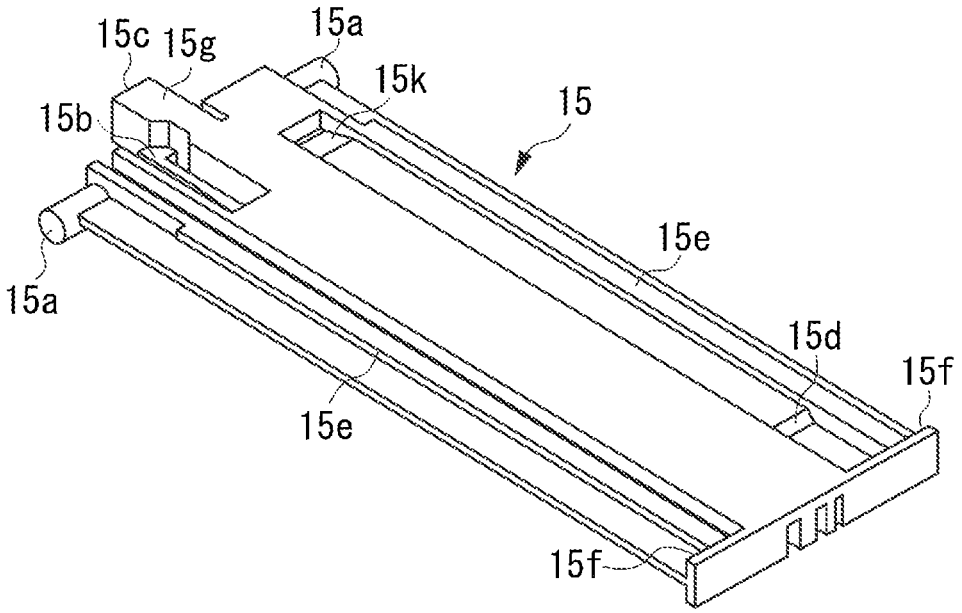
FIG. 4A is a perspective view illustrating a slide member according to the first exemplary embodiment.
Figure 4B:
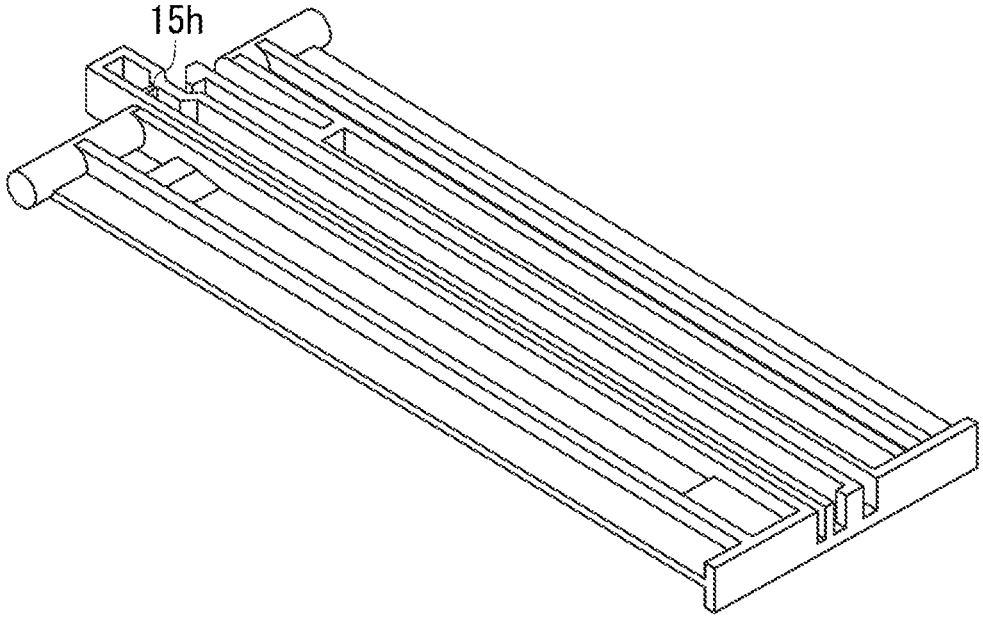
FIG. 4B is a perspective view illustrating the slide member illustrated in FIG. 4A as seen from the bottom.

FIG. 4A is a perspective view illustrating the slide member 15. FIG. 4B is a perspective view of the slide member 15 illustrated in FIG. 4A as seen from the bottom. The slide member 15 includes the hook 15*b* serving as an engagement portion and the downstream end 15*c*, which contacts the contact surface 12*e* of the feeding tray 12. Moreover, the slide member 15 includes a pair of second guide portions 15*e* and 15*e* that regulate the rear-end regulating member 14. Moreover, the slide member 15 includes an inclined surface 15*d*, a pair of contact surfaces 15*f* and 15*f*, a projection portion 15*g*, and a rear-end stopper surface 15*h*. When the downstream end 15*c* of the projection portion 15*g* contacts the contact surface 12*e*, movement of the slide member 15 is regulated.

Figure 5A:
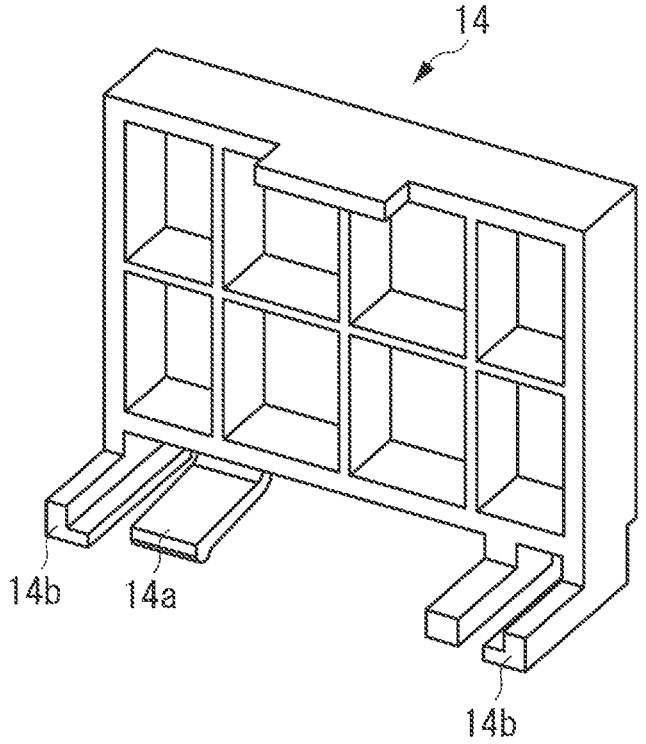
FIG. 5A is a perspective view illustrating a rear-end regulating member according to the first exemplary embodiment.
Figure 5B:
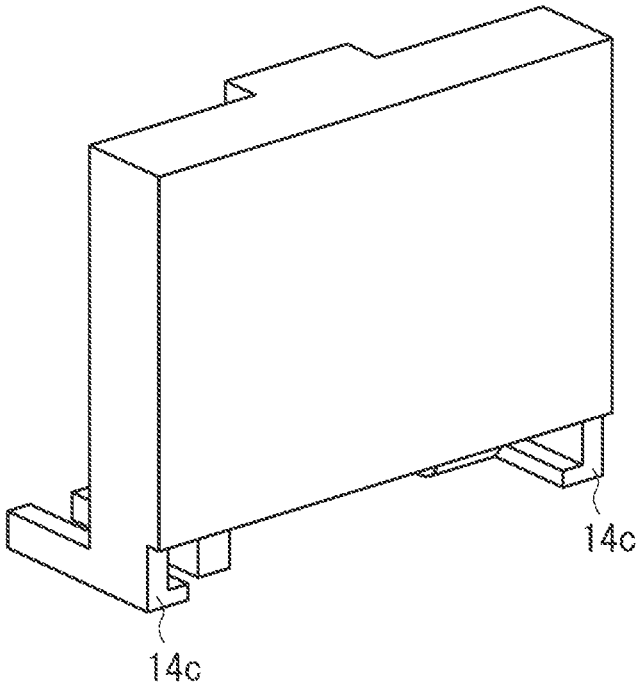
FIG. 5B is a perspective view illustrating the rear-end regulating member illustrated in FIG. 5A as seen from the backside.

FIG. 5A is a perspective view illustrating the rear-end regulating member 14. FIG. 5B is a perspective view of the rear-end regulating member 14 illustrated in FIG. 5A as seen from the backside. A pair of guided portions 14*b* and 14*b* of the rear-end regulating member 14 engages the pair of the guide portions 15*e* and 15*e* of the slide member 15, so that the rear-end regulating member 14 is supported in a slidable manner with respect to the slide member 15. Moreover, the rear-end regulating member 14 includes a pawl 14*a*, and engagement of the pawl 14*a* with the inclined surface 15*d* of the slide member 15 regulates a position of the rear-end regulating member 14 with respect to the slide member 15. Moreover, the rear-end regulating member 14 includes a positioning surface 14*c* used for determination of the position of the rear-end regulating member 14 with respect to the slide member 15.

Next, relative positions of the rear-end regulating member 14, the feeding tray 12, and the slide member 15 are described with reference to FIGS. 6A to 8B.

Figure 6A:
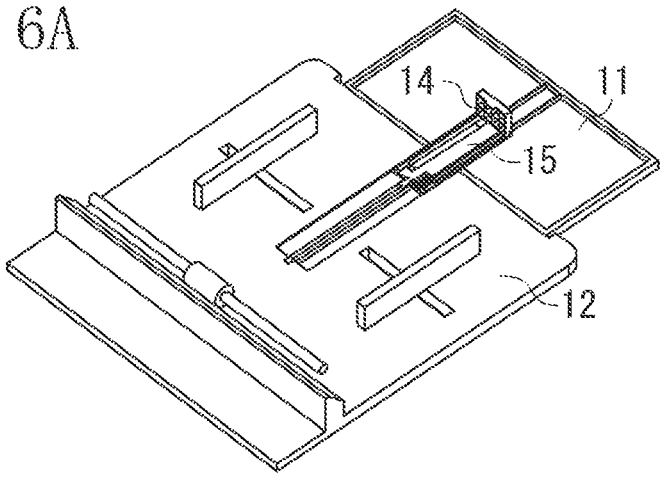
FIGS. 6A, 6B, and 6C are perspective views each illustrating a position of the rear-end regulating member according to the first exemplary embodiment.
Figure 6B:
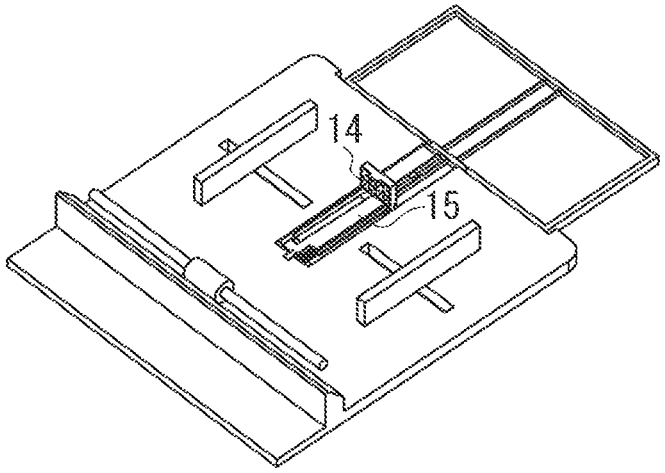
Figure 6C:
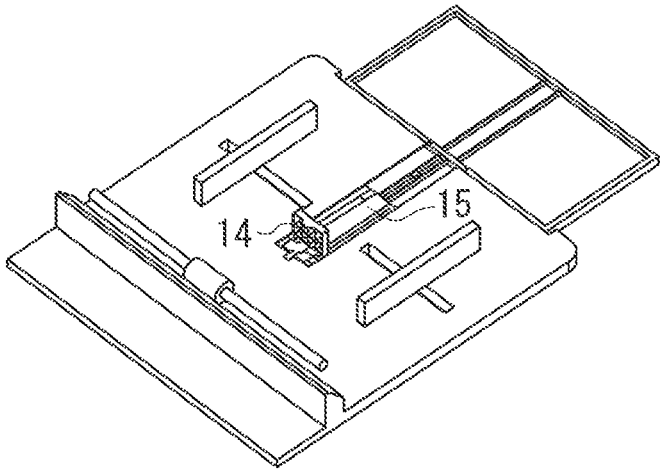
Figure 7A:
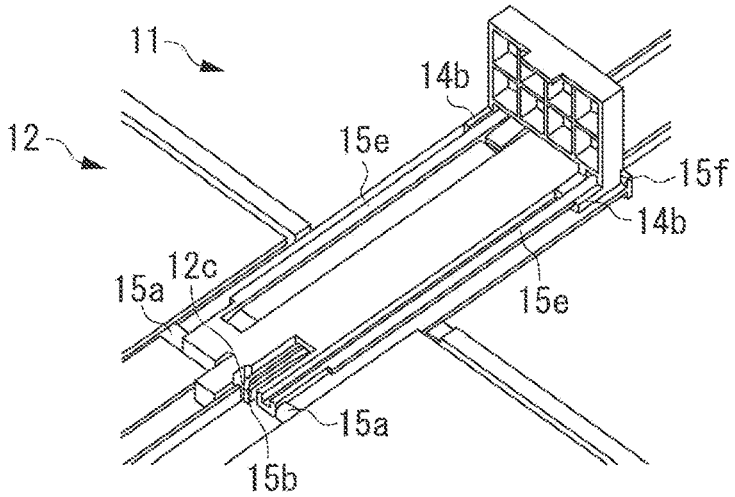
FIGS. 7A, 7B, and 7C are enlarged views illustrating peripheries of the rear-end regulating members and the slide members respectively illustrated in FIGS. 6A, 6B, and 6C.
Figure 7B:
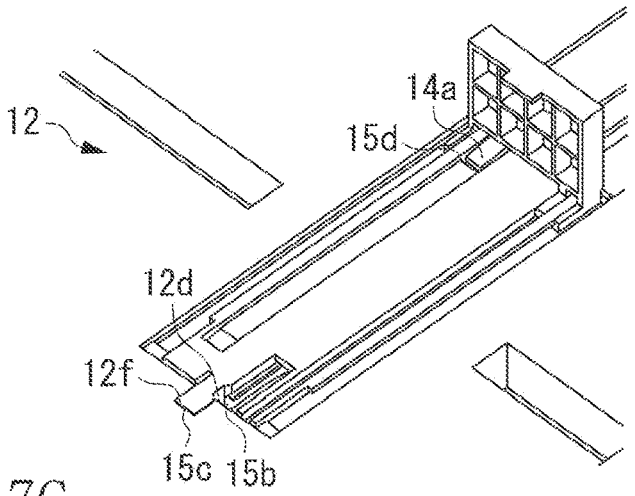
Figure 7C:
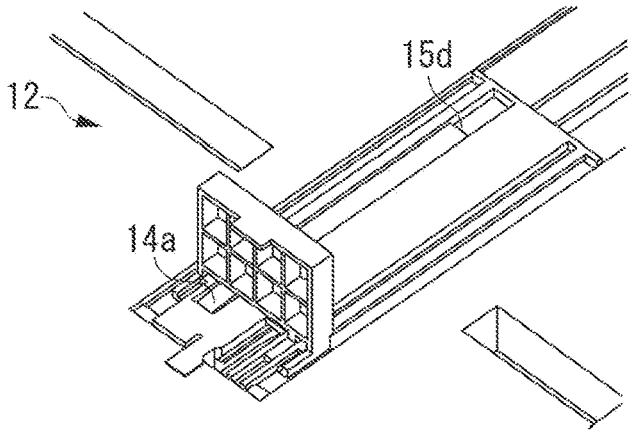

FIG. 6A is a perspective view illustrating a position of the rear-end regulating member 14, and FIG. 7A is an enlarged view of the periphery of the slide member 15 and the rear-end regulating member 14 illustrated in FIG. 6A. Similarly, FIG. 7B is an enlarged view of one portion of the perspective view illustrated in FIG. 6B, and FIG. 7C is an enlarged view of one portion of the perspective view illustrated in FIG. 6C.

Each of FIGS. 6A and 7A illustrates a position in which the rear-end regulating member 14 regulates a rear end of a maximum size sheet. Each of FIGS. 6C and 7C illustrates a position in which the rear-end regulating member 14 regulates a rear end of a minimum size sheet. FIG. 6B illustrates a position between the positions illustrated in FIGS. 6A and 6C, whereas FIG. 7B illustrates a position between the positions illustrated in FIGS. 7A and 7C.

As mentioned above, each of FIGS. 6A and 7A illustrates the position of the rear-end regulating member 14 when the rear-end regulating member 14 regulates the rear end of the maximum size sheet. The hook 15*b* engages the second engaged portion 12*c*, and such engagement regulates movement of the slide member 15 in an upstream-downstream direction with respect to the feeding tray 12. In other words, the second engaged portion 12*c* is arranged on the feeding tray 12 according to the maximum size sheet.

The rear-end stopper surface 15*h* is arranged with a space of several millimeters with respect to the stopper rib 12*g* such that the slide member 15 is prevented from being separated from the feeding tray 12 when the slide member 15 is further moved in a downstream direction. Moreover, the guided portion 14*b* of the rear-end regulating member 14 engages the guide portion 15*e* of the slide member 15. The positioning surface 14*c* contacts the contact surface 15*f*, so that a position of the positioning surface 14*c* is regulated. Moreover, a position of the pawl 14*a* with respect to the inclined surface 15*d* is regulated. Thus, the rear-end regulating member 14 is regulated while having a gap with respect to the slide member 15. That is, a state in which not only the rear-end regulating member 14 is regulated by the inclined surface 15*d* and the contact surface 15*f* of the slide member 15, but also the slide member 15 engages the second engaged portion 12*c* is defined as a first state. In the first state, one area of the slide member 15 is supported by the feeding tray 12, and the other areas thereof are supported by the open-close cover 11. In this state, the slide member 15 is in a first position.

When the rear-end regulating member 14 is pushed toward a downstream side from the state illustrated in FIG. 7A, the pawl 14*a* contacts the inclined surface 15*d*. When the rear-end regulating member 14 is further pushed toward the downstream side, the slide member 15 receives force from the pawl 14*a*, and the hook 15*b* contacts a downstream end portion of the groove portion 12*c*. Accordingly, the hook 15*b* is deformed and then separated from the groove portion 12*c*, so that the rear-end regulating member 14 and the slide member 15 are integrally moved to the downstream side.

As illustrated in FIG. 7B, the contact surface 15*c* contacts the contact surface 12*f*, and the movement of the slide member 15 stops. In such a state, the hook 15*b* engages the first engaged portion 12*d*, thereby regulating the movement of the slide member 15 in the downstream direction with respect to the feeding tray 12. That is, a state in which not only the rear-end regulating member 14 is regulated by the inclined surface 15*d* and the contact surface 15*f* of the slide member 15, but also the slide member 15 engages the first engaged portion 12*d* is defined as a second state.

When the rear-end regulating member 14 is further pushed toward the downstream side from the state illustrated in FIG. 7B, the pawl 14*a* is separated from the inclined surface 15*d* and only the rear-end regulating member 14 is moved toward the downstream side as illustrated in FIG. 7B. Then, the pawl 14*a* of the rear-end regulating member 14 engages a second inclined surface 15*k* (see FIG. 4). Such engagement regulates a position of the rear-end regulating member 14 with respect to the slide member 15. That is, a state in which not only the rear-end regulating member 14 is regulated by the second inclined surface 15*k* of the slide member 15, but also the slide member 15 engages the first engaged portion 12*d* is defined as a third state. In each of the second state and the third state, the entire area of the slide member 15 is supported by the feeding tray 12. The slide member 15 in such a state is in a second position.

In the first state, the open-close cover 11 may be moved from an open state to a closed state. In the first state, since the slide member 15 is arranged on the open-close cover 11, the rotation of the open-close cover 11 causes a collision of the open-close cover 11 with the slide member 15. In a case where the open-close cover 11 and the slide member 15 collide, the slide member 15 needs to be rotated according to rotation of the open-close cover 11. Otherwise, the slide member 15 may be bent or broken by the open-close cover 11.

Figure 8A:
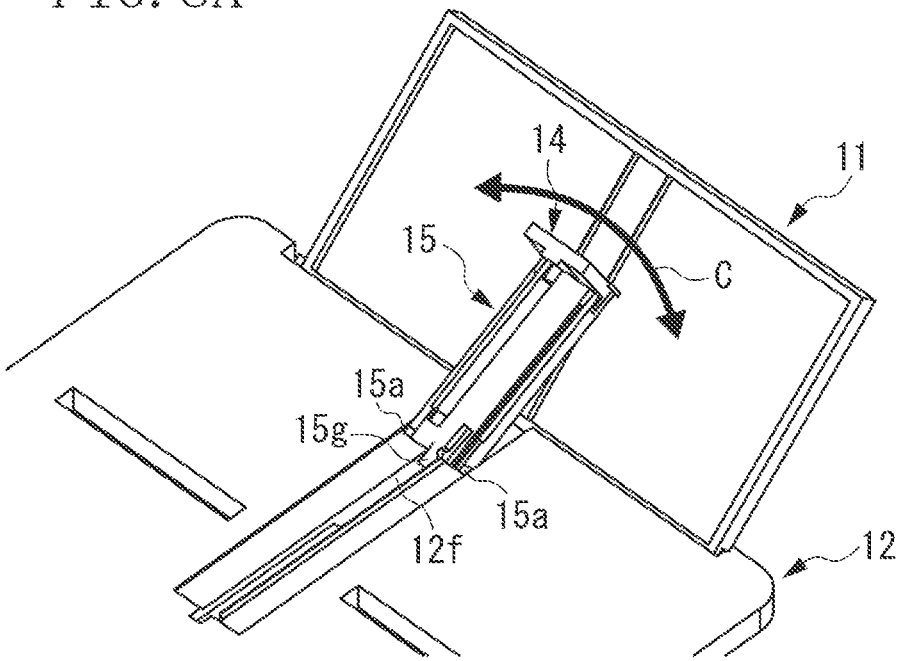
FIGS. 8A and 8B are perspective views illustrating a state in which the slide member is rotated when an open-close member is rotated according to the first exemplary embodiment.
Figure 8B:
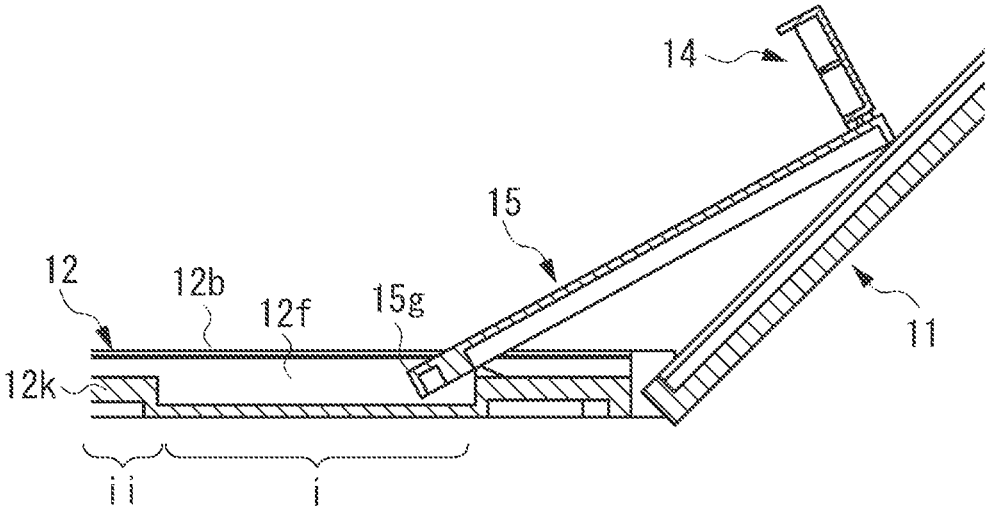

FIG. 8A is a perspective view illustrating a state in which the slide member 15 is rotated when the open-close cover 11 is rotated. FIG. 8B is a schematic sectional view illustrating the state illustrated in FIG. 8A. As illustrated in FIG. 8B, if the open-close cover 11 is closed in the first state, the rotation shaft portion 15*a* follows the rotation of the open-close cover 11 by using the slide guide portions 12*b* and 12*b* as bearings on both sides. According to the present exemplary embodiment, therefore, the slide member 15 which moves in a sliding manner with respect to the feeding tray 12 is rotatable with respect to the feeding tray 12 such that the slide member 15 follows the rotation of the open-close cover 11. With such a configuration, the slide member 15 can be rotated with a simple configuration, and the number of components can be reduced.

Moreover, since the slide member 15 directly contacts the contact surface 12*c* of the feeding tray 12, feeding-direction lengths of the slide guide portions 12*b* and 12*b* forming the feeding tray 12 can be shortened. As a result, a space for the rear-end regulation configuration can be reduced, thereby enhancing a degree of flexibility in design of other mechanisms of the sheet feeding device 102.

Moreover, in the vicinity of the second engaged portion 12*c*, the feeding tray 12 includes the groove portion 12*f* serving as a retraction portion in which the projection portion 15*g* including the contact surface 15*c* is retracted. The projection portion 15*g* and the groove portion 12*f* are engaged, and thus the use of the groove portion 12*f* restricts accidental movement of the slide member 15 in a direction (a feeding direction width direction) indicated by an arrow C shown in FIG. 8A. That is, accidental movement of the slide member 15 in the feeding direction width direction can be restricted, and good usability is provided. Moreover, the slide member 15 is prevented from being separated from the feeding tray 12.

As illustrated in FIG. 8B, the groove portion 12*f* is arranged on only an upstream side (corresponding to an area i illustrated in FIG. 8B) in the feeding direction. The groove portion 12*f* is not arranged on a downstream side in the feeding direction. Accordingly, when the slide member 15 is intended to be rotated, the projection portion 15*g* of the slide member 15 contacts a rotation regulating portion 12*k*. Consequently, the slide member 15 cannot be rotated. This can prevent accidental movement of the slide member 15.

The first exemplary embodiment has been described using the configuration in which the slide member 15 is slidable with respect to the feeding tray 12. In a second exemplary embodiment, a slide member 25 is not only slidably movable with respect to an open-close member 21 serving as an open-close cover, but also rotatable. Since the second exemplary embodiment is similar to the first exemplary embodiment except for the configurations of the slide member 25 and the open-close member 21, the other configurations that are similar to those described in the first exemplary embodiment are given the same reference numerals as above.

Figure 10:
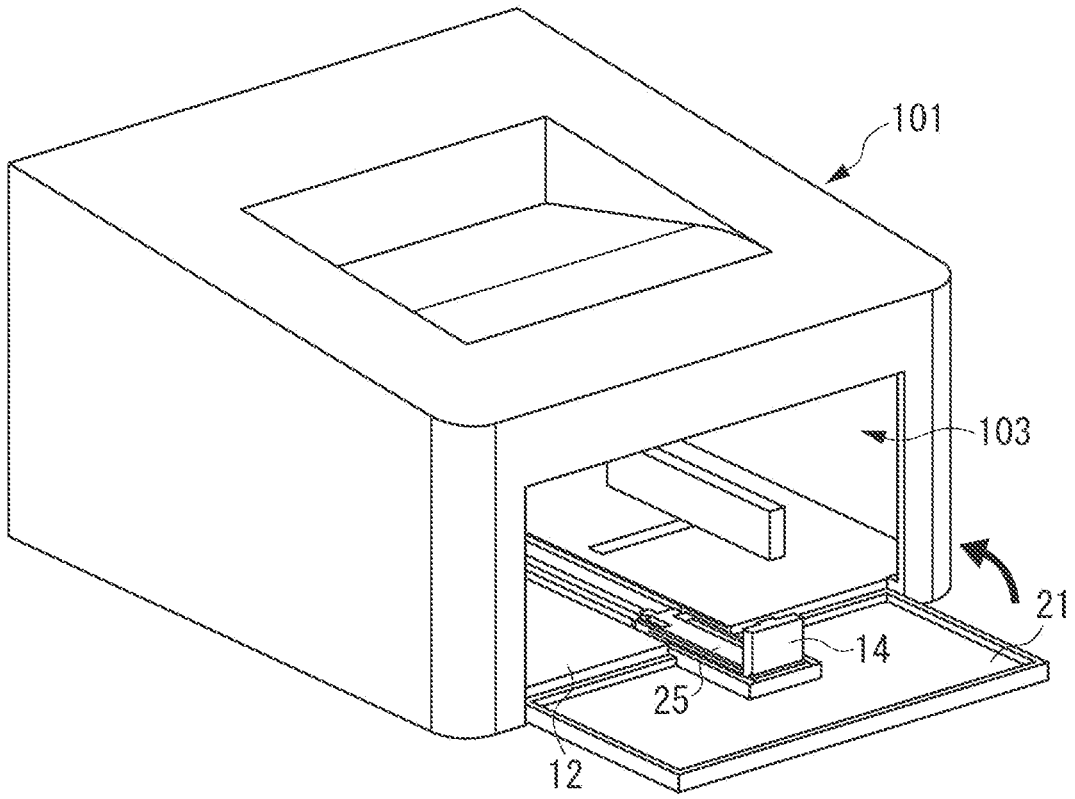
FIG. 10 is a perspective view illustrating an image forming apparatus according to a second exemplary embodiment.

FIG. 10 illustrates an image forming apparatus according to the second exemplary embodiment. The image forming apparatus of the second exemplary embodiment includes the slide member 25 instead of the slide member 15 of the first exemplary embodiment, and the open-close cover 21 instead of the open-close cover 11 of the first exemplary embodiment.

Figure 11:
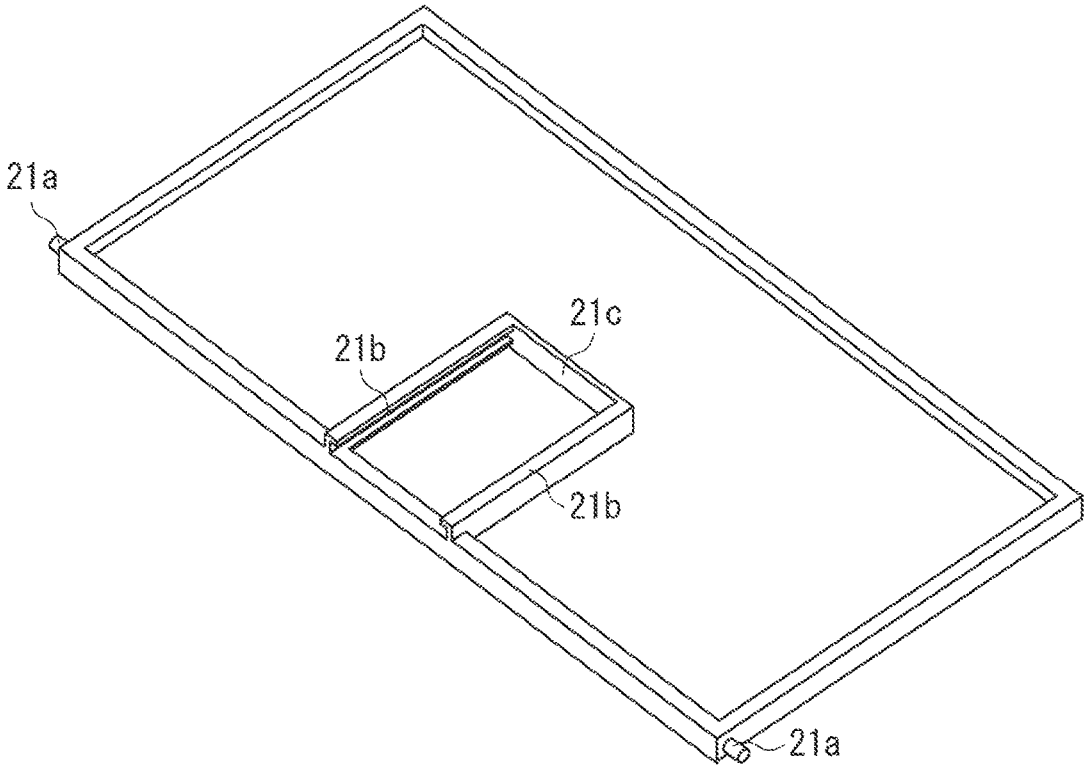
FIG. 11 is a perspective view illustrating an open-close member according to the second exemplary embodiment.

FIG. 11 is a perspective view illustrating the open-close cover 21. The open-close member 21 includes a rotation shaft 21*a*, an open-close guide portion 21*b*, and a stopper surface 21*c*. The open-close guide portion 21*b* is a guide portion that causes the slide member 25 to move in a sliding manner on the open-close cover 21. Moreover, the stopper surface 21*c* serves as a regulation surface that regulates a position of the slide member 25 in a feeding direction.

Figure 12:
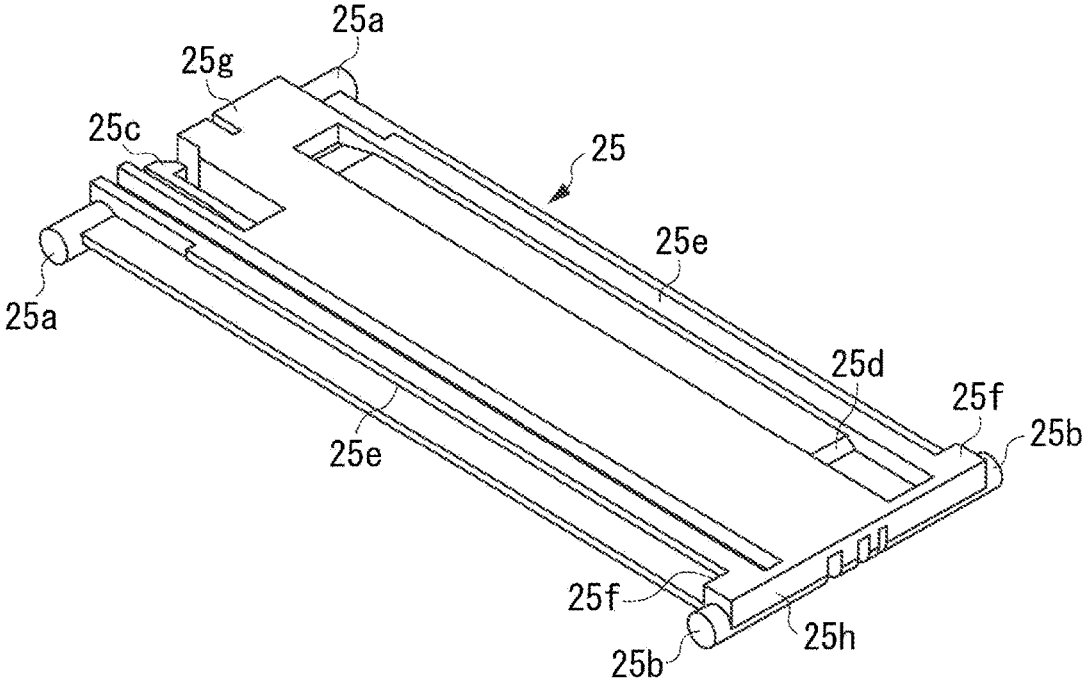
FIG. 12 is a perspective view illustrating a slide member according to the second exemplary embodiment.

FIG. 12 is a perspective view illustrating the slide member 25 according to the second exemplary embodiment. The slide member 25 includes a second rotation shaft portion 25*b* with respect to a first rotation shaft portion 25*a*. In the slide member 25, the second rotation shaft portion 25*b* is arranged on an upstream side in the feeding direction. Moreover, the slide member 25 includes a hook 25*c*, an inclined surface 25*d*, a guide portion 25*e*, a contact surface 25*f*, a contact surface 25*g*, and a stopper surface 25*h*.

Next, operation of a rear-end regulating member 14 is described. FIG. 14A is an enlarged view of the periphery of the slide member 25 and the rear-end regulating member 14 illustrated in FIG. 13A. Similarly, FIG. 14B is an enlarged view of one portion of the perspective view illustrated in FIG. 13B, and FIG. 14C is an enlarged view of one portion of the perspective view illustrated in FIG. 13C.

Figure 13A:
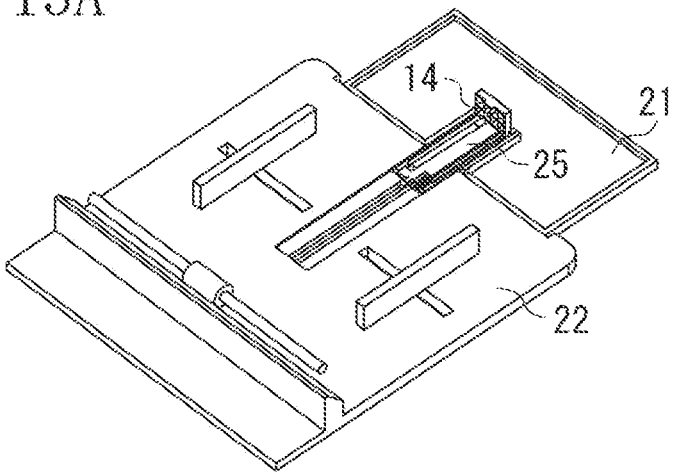
FIGS. 13A, 13B, and 13C are perspective views each illustrating a position of a rear-end regulating member according to the second exemplary embodiment.
Figure 13B:
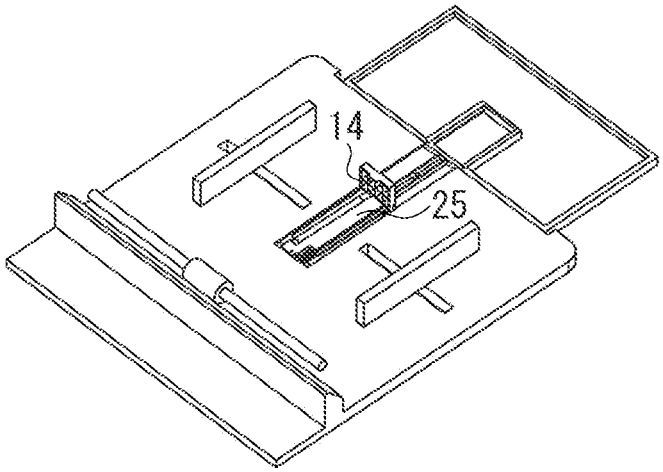
Figure 13C:
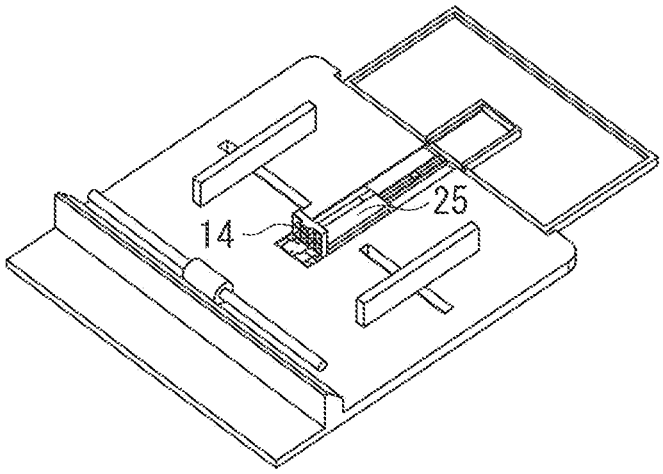
Figure 14A:
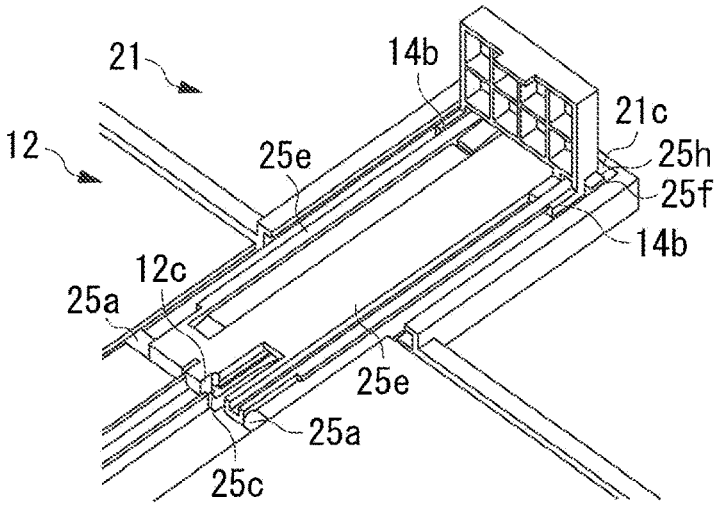
FIGS. 14A, 14B, and 14C are enlarged views illustrating peripheries of the rear-end regulating members and the slide members respectively illustrated in FIGS. 13A, 13B, and 13C.
Figure 14B:
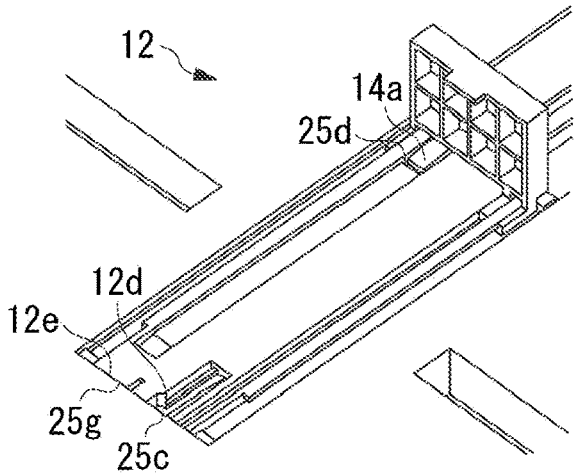
Figure 14C:
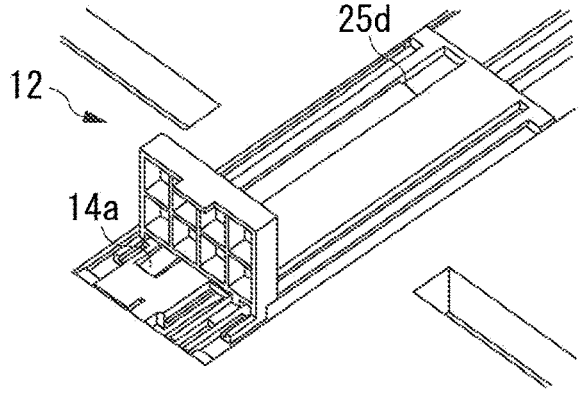

As illustrated in FIGS. 13A, 13B, and 13C, the rear-end regulating member 14 and the slide member 25 are movable according to a length of a sheet S. FIG. 13A illustrates a position used when a rear end of a maximum size sheet is regulated. FIG. 13C illustrates a position used when a rear end of a minimum size sheet is regulated.

FIG. 14A illustrates a position in which the rear-end regulating member 14 regulates the rear end of the maximum size sheet. A hook 14*c* engages a groove portion 12*c*, so that movement of the slide member 25 in an upstream downstream direction is regulated with respect to the feeding tray 12. The stopper surface 21*c* is arranged with a space of several millimeters with respect to the stopper surface 25*h* such that the slide member 25 is prevented from being separated from the feeding tray 12 when the slide member 25 is further moved in a downstream direction. Moreover, a guided portions 14*b* of the rear-end regulating member 14 engages the guide portion 25*e* of the slide member 25. The contact surface 14*c* contacts the contact surface 25*f*, so that a position of the contact surface 14*c* is regulated. Moreover, a position of the pawl 14*a* with respect to the inclined surface 25*d* is regulated. Thus, the rear-end regulating member 14 is regulated while having a gap with respect to the slide member 25.

When the rear-end regulating member 14 is pushed toward the downstream side from the state illustrated in FIG. 14A, the pawl 14*a* contacts the inclined surface 25*d*. When the rear-end regulating member 14 is further pushed toward the downstream side, the slide member 25 receives force from the pawl 14*a*, and the hook 25*c* contacts a downstream end portion of the groove portion 12*c*. Accordingly, the hook 25*c* is deformed and then separated from the groove portion 12*c*, so that the rear-end regulating member 14 and the slide member 25 are integrally moved to the downstream side.

As illustrated in FIG. 14B, the contact surface 25*g* contacts a contact surface 12*e*, and movement of the slide member 25 stops. In such a state, the hook 25*c* engages a hole 12*d*, thereby regulating movement of the slide member 25 in the downstream direction with respect to the feeding tray 12. If the rear-end regulating member 14 is further pushed toward the downstream side from the state illustrated in FIG. 14B, the pawl 14*a* is separated from the inclined surface 25*d* and only the rear-end regulating member 14 is moved to the downstream side as illustrated in FIG. 14C.

Figure 15:
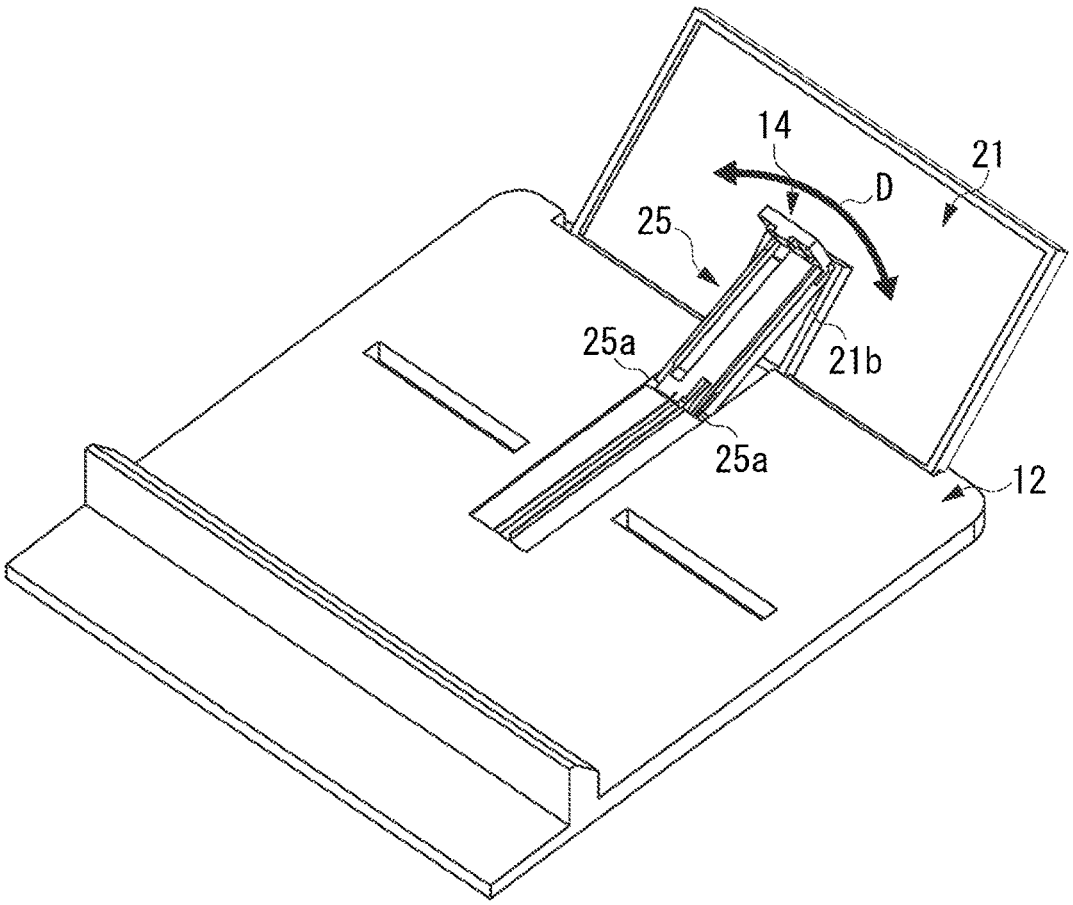
FIG. 15 is a perspective view illustrating a state in which the slide member is rotated when an open-close member is rotated according to the second exemplary embodiment.

As illustrated in FIG. 15, when the open-close cover 21 is closed in a state in which the rear-end regulating member 14 is pulled to a position on the open-close cover 21, the slide member 25 moves in a sliding manner and rotates around the first rotation shaft portion 25*a* with respect to the feeding tray 12. Meanwhile, the slide member 25 rotates around the second rotation shaft portion 25*b* with respect to the open-close cover 21, and thus the slide member 25 is not damaged. The second rotation shaft portion 25*b* is arranged in a slidably movable manner along the guide portion 21*b*. Such arrangement can restrict accidental movement of the slide member 25 in a direction indicated by an arrow D (a feeding direction width direction) illustrated in FIG. 15.

According to the present exemplary embodiment, therefore, the slide member 25 which moves in a sliding manner with respect to the feeding tray 12 is rotatable with respect to the feeding tray 12 and the open-close cover 21 so as to follow rotation of the open-close cover 21. With such a configuration, the slide member 25 can be rotated with a simple configuration, and the number of components can be reduced. Moreover, similar to the first exemplary embodiment, accidental movement of the slide member 25 in a feeding direction width direction can be restricted, and separation of the slide member 25 from the feeding tray 12 can be limited, thereby providing good usability.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-156769, filed Aug. 9, 2016, which is hereby incorporated by reference herein in its entirety.

What is claimed is:

1. A sheet feeding device for feeding a sheet, the sheet feeding device comprising:

a support unit configured to support the sheet;

a feeding unit configured to feed the sheet supported by the support unit;

an open-close member, arranged on an upstream side of the support unit in a feeding direction of the sheet and rotatably supported between an open position and a closed position with respect to the support unit, and configured to support the sheet in the open position with the support unit;

a slide member supported in a slidably movable manner in the feeding direction with respect to the support unit, wherein the slide member includes a rotation shaft portion on a downstream side in the feeding direction and a projection portion configured to contact the support unit to regulate a position of the feeding direction; and a regulation member, supported by the slide member, configured to regulate a position of a sheet on an upstream end of the regulated sheet in the feeding direction of the sheet, where the regulated sheet is a sheet supported by the support unit or a sheet supported by the support unit and the open-close member, wherein the support unit includes a guide portion configured to movably guide the rotation shaft portion, wherein, if the open-close member is rotated from the open position toward the closed position in a state in which the open-close member is in contact with the slide member, the slide member rotates by following movement of the open-close member with respect to the guide portion around the rotation shaft portion, and wherein the support unit includes a retraction portion in which the projection portion is retracted when the slide member rotates with respect to the guide portion by following movement of the open-close member.

2. The sheet feeding device according to claim 1, wherein the rotation shaft portion projects toward the guide portion from the slide member in a width direction perpendicular to the feeding direction.

3. The sheet feeding device according to claim 1, wherein the regulation member is supported in a slidably movable manner in the feeding direction with respect to the slide member.

4. The sheet feeding device according to claim 3, wherein the slide member is movable between a first position in which an entire area of the slide member is supported by the support unit in the feeding direction and a second position in which one area of the slide member is supported by the support unit and other areas of the slide member are supported by the open-close member.

5. The sheet feeding device according to claim 4, wherein the slide member includes an engagement portion engageable with the support unit.

6. The sheet feeding device according to claim 5, wherein the support unit includes a first engaged portion configured to engage the engagement portion if the slide member is positioned in the first position, and a second engaged portion configured to engage the engagement portion if the slide member is positioned in the second position.

7. The sheet feeding device according to claim 6, wherein the projection portion configured to contact the support unit to regulate a position of the feeding direction in a case where the slide member is positioned in the first position.

8. The sheet feeding device according to claim 1, wherein the retraction portion includes a groove portion arranged between the guide portions.

9. The sheet feeding device according to claim 8, wherein the retraction portion is arranged corresponding to the second position.

10. An image forming apparatus comprising:

an image forming unit configured to form an image on a sheet; and a sheet feeding device for feeding the sheet, the sheet feeding device comprising:

a support unit configured to support the sheet, a feeding unit configured to feed the sheet supported by the support unit, an open-close member, arranged on an upstream side of the support unit in a feeding direction of the sheet and rotatably supported between an open position and a closed position with respect to the support unit, and configured to support the sheet in the open position with the support unit, a slide member supported in a slidably movable manner in the feeding direction with respect to the support unit, wherein the slide member includes a rotation shaft portion on a downstream side in the feeding direction and a projection portion configured to contact the support unit to regulate a position of the feeding direction, and a regulation member, supported by the slide member, configured to regulate a position of a sheet on an upstream end of the regulated sheet in the feeding direction of the sheet, where the regulated sheet is a sheet supported by the support unit or a sheet supported by the support unit and the open-close member, wherein the support unit includes a guide portion configured to movably guide the rotation shaft portion, wherein, if the open-close member is rotated from the open position toward the closed position in a state in which the open-close member is in contact with the slide member, the slide member rotates by following movement of the open-close member with respect to the guide portion around the rotation shaft portion, and wherein the support unit includes a retraction portion in which the projection portion is retracted when the slide member rotates with respect to the guide portion by following movement of the open-close member.

* * * * *